United States Patent [19]

Rivas et al.

[11] Patent Number: 4,913,230

[45] **Date of Patent: * Apr. 3, 1990**

[54] SUCKER ROD CENTRALIZER

[75] Inventors: Olegario Rivas, Dtto. Sucre Edo Miranda; Alejandro Newski, Los Teques Edo. Miranda, both of Venezuela

[73] Assignee: Intevep, S.A., Caracas, Venezuela

[ * ] Notice: The portion of the term of this patent subsequent to Jan. 3, 2006 has been disclaimed.

[21] Appl. No.: 364,130

[22] Filed: Jun. 12, 1989

Related U.S. Application Data

[63] Continuation of Ser. No. 98,929, Sep. 21, 1987, Pat. No. 4,871,020.

[51] Int. Cl.[4] ..... E21B 17/10

[52] U.S. Cl. ..... 166/241; 175/325

[58] Field of Search ..... 166/241, 176; 175/325

[56] References Cited

U.S. PATENT DOCUMENTS

| | | | |
|---|---|---|---|
| 713,723 | 6/1902 | Vinzent | 175/325 |
| 1,281,756 | 2/1918 | Black | 175/325 |
| 1,827,835 | 10/1931 | Black | 175/325 |
| 2,198,720 | 4/1940 | Edgecomb et al. | 166/241 |
| 2,466,239 | 4/1949 | Holcombe | 166/241 |
| 2,601,478 | 9/1952 | Weir | 175/325 |
| 2,722,462 | 11/1955 | Tschirley | 166/241 |
| 3,938,853 | 2/1976 | Jurgens | 166/241 |
| 4,557,327 | 12/1985 | Kinley et al. | 166/241 |
| 4,620,802 | 11/1986 | Harrel | 175/325 |
| 4,621,690 | 11/1986 | Klyne | 166/241 |

*Primary Examiner*—Bruce M. Kisliuk

*Attorney, Agent, or Firm*—Bachman & LaPointe

[57] ABSTRACT

The present invention relates to a device for centralizing at least one sucker rod within a production pipe and for reducing frictional forces between the pipe and the sucker rod(s). The device comprises an elongate, substantially cylindrical body member, a plurality of slots within the member and a rotatable member in each slot. Each rotatable member is formed from a metallic material having a hardness of at least about 50 Brinnel Hardness, less than the hardness of the material forming the production pipe tubing. In a preferred embodiment, the slots and the rotatable members are in a helical array.

7 Claims, 1 Drawing Sheet

SUCKER ROD CENTRALIZER

This is a continuation of application Ser. No. 098,929 filed Sept. 21, 1987 now U.S. Pat. No. 4,871,020.

BACKGROUND OF THE INVENTION

The present invention relates to oil production and in particular to a sucker rod guide centralizer for preventing production pipe and sucker rod wear by reducing friction forces between them.

Oil is withdrawn from subterranean formations through a tubular production pipe formed from a string of tubing extending to the surface. The oil is lifted through the pipe by the action of a downhole pump actuated by a sucker rod string which is reciprocated at the surface by a pump jack. A sucker rod string is made up of a multiplicity of individual sucker rods joined together end to end. Each sucker rod comprises a main stem having a diameter typically in the range of from ¾" to 1½" and a length of about 30 feet.

In recent years, directional and deviated wells have become very popular in many oil fields. The use of sucker rod strings in directional or deviated well bores has had problems. The rod string usually formed from steel tends to lie along the low side of the production pipe and with time reciprocation of the rod string tends to wear away the wall of the pipe. Additional problems arise from the steam injection techniques used to improve the production of heavy and extra heavy crude oils.

Attempts have been made to deal with the frictional problems associated with tools or tubular structures used in production pipes by incorporating a centralizing device therein which serves to space the tool or tubular structure from the production pipe tubing and thereby reduce wear of the tubing wall. These centralizing devices have taken different forms such as a series of projections on the outer periphery of a coupling member and rollers or bearings incorporated within the structure of the sucker rod. U.S. Pat. No. 2,722,462 to Tschirley illustrates one such device comprising an elastomeric collar having a row of bumps or projections attached to a drill pipe. The bumps on the collar are designed to maintain a desired separation between the pipe and the surrounding casing. U.S. Pat. No. 3,938,853 to Jurgens et al. illustrates a similar stabilizing device secured to a drill collar. The device has an inner sleeve and an outer sleeve with a series of longitudinally extending helical ribs. The primary deficiency of these devices is believed to be their tendency to wear out as a result of the frictional contact between the fixed centralizing elements and the production pipe.

U.S. Pat. No. 2,466,239 to Holcombe, U.S. Pat. No. 2,601,748 to Weir and U.S. Pat. No. 4,577,327 to Kinley et al. illustrate guides using rollers or bearings. In Holcombe, a series of wheels or rollers are mounted to a rod by a wing and keeper plate arrangement. In Weir, the bearing balls used to guide the sucker rod are located in a series of longitudinally extending grooves having intermediate races about the periphery of the rod. In Kinley et al., the centralizing device comprises a plurality of spring loaded centering arms having a series of rollers in a center segment.

More recently, a centralizing device comprising a coupling device having a cylindrical body and a plurality of lenticular wheels positioned within slots in the body has been developed. To minimize scoring of the tubing wall, the wheel members are formed of a hard, non-abrasive material such as hard nylon. U.S. Pat. No. 4,621,690 to Klyne illustrates such a device.

Many of these devices when tested in wells having a temperature above 500° F. have failed in giving high performance work life. Often, the non-metallic components of the devices are the weak links because they cannot withstand the critical conditions in the oil wells. In the wheeled devices, failure is also often the result of too few wheels being in contact with the production pipe tubing.

Accordingly, it is an object of the present invention to provide a device for centralizing a sucker rod string within a production pipe and for reducing frictional forces therebetween.

It is a further object of the present invention to provide a device as above capable of withstanding typical oil well service conditions.

These and other objects and advantages will become more apparent from the following description and drawings.

SUMMARY OF THE INVENTION

The device for centralizing a sucker rod string within a production pipe and for reducing friction therebetween of the present invention comprises an elongate, substantially cylindrical body member having a plurality of slots therein and a rotatable member mounted within each slot. This device represents an improvement over earlier devices in that each rotatable member is made from a metal or metal alloy having a hardness which is between about 50 to 150 Brinnel Hardness, preferably about 50 Brinnel Hardness, less than the hardness of the harder production pipe tubing material at well operating temperatures above 300° F. Suitable metal materials for the rotatable members include but are not limited to copper alloys and austenistic or ferritic stainless steel.

A further feature of the present invention is the arrangement of the slots within the body members so as to form a helical array of rotatable members. In a preferred arrangement, the rotatable members are set at about thirty degrees clockwise with respect to adjacent ones of the rotatable members. It has been found that by providing such an array at least three of the rotatable members can be placed in contact with the production pipe tubing at one time.

The body member is preferably made of quenched and tempered steel and is provided with threaded boxes at each end for connection to a plurality of sucker rods. The location and number of sucker rod centralizer devices used in a sucker rod string depend upon the deviation degree and depth of the well.

DETAILED DESCRIPTION

Figure 1:
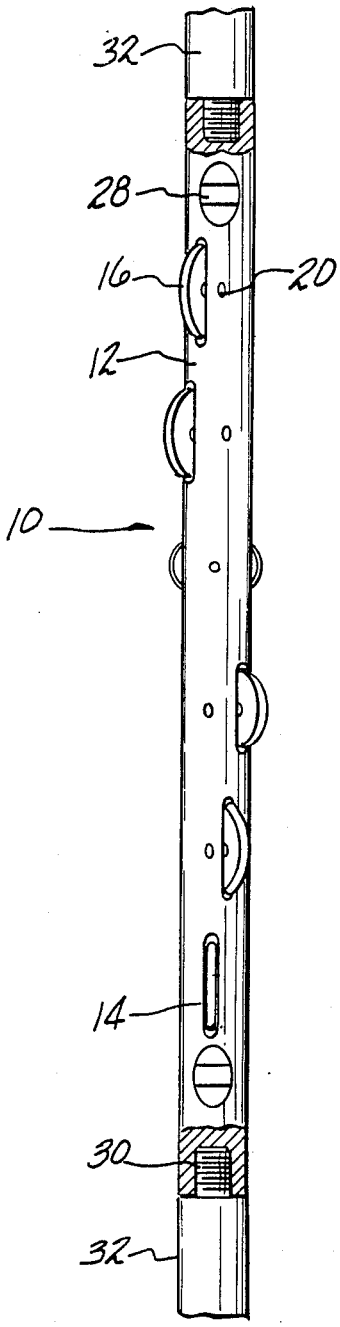
FIG. 1 is a view in partial cross section of the centralizing device of the present invention.
Figure 2:
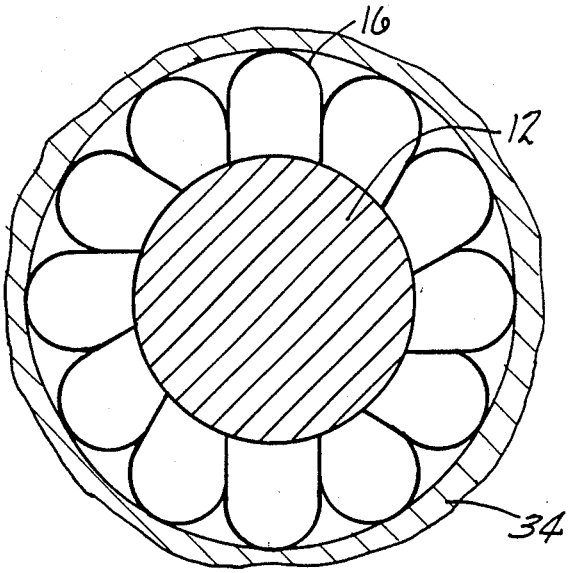
FIG. 2 is a sectional view of the device of FIG. 1.
Figure 3:
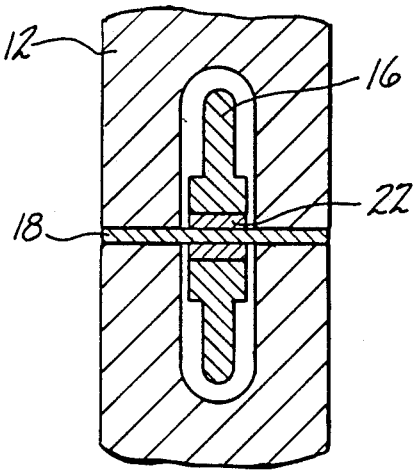
FIG. 3 is a sectional view of a portion of device of FIG. 1 illustrating the mounting of a rotatable member with a slot.

Referring now to the drawings, the sucker rod string centralizing device 10 is formed by an elongate, substantially cylindrical body member 12. The member 12 may have any desired length and diameter and may be formed from any suitable material such as quenched and tempered steel. For example, the member 12 may be manufactured in sizes of ¾", ⅞", 1", 1⅛", 1¼" and 1½" to match commercial sucker rods.

The body member 12 may also have one or more flat surfaces or portions 28 to permit wrenching of the centralizer device. In addition, internally threaded, longitudinally extending boxes 30 may be provided at each end for permitting the device 10 to be connected to one or more sucker rods 32 having mating threaded pin ends.

A plurality of slots 14 are machined within the body member 12 for the purpose of accommodating a plurality of rotatable members 16, such as wheels or rollers, which serve to centralize the sucker rod string within the production tubing and reduce frictional forces therebetween. Each slot 14 preferably extends transversely through the member 12 and is oriented to have its longitudinal dimension substantially parallel to the longitudinal axis of the member 12. While each slot may have any desired width, it is preferred that it be just slightly wider than the thickness t of a central portion 24 of the rotatable member 16 so as to substantially limit rotation of the member 16 to a plane substantially parallel to the longitudinal axis of the member 12.

The slots 14 are arranged about the body member 12 and are preferably set at an angle of about thirty degrees relative to each other. They are further arranged so as to form a helicoidal array. It has been found that by providing such a array, the total rotatable member surface area in contact with the production tubing is improved. Further, the forces acting per rotatable member are substantially decreased, thus improving the service life of both the device 10 and the production tubing. Still further, the probability of rotatable member failure is reduced as compared to other arrangements since the forces usually act substantially perpendicular to the rotatable member.

A rotatable member 16 such as a wheel is mounted for rotation in each slot 14 about an axis defined by a pin 18 having its ends positioned in bores 20. Any suitable means known in the art may be used to lock each pin within the bores 20. In a preferred arrangement, the pin 18 is oriented substantially transversely to both the longitudinal axis of the body member and the longitudinal dimension of the slot. Each pin is preferably formed from quenched and tempered steel. The member 16 is mounted for rotation about the pin 18 by an intermediate bearing 22. The use of an intermediate bearing 22 has been found to improve the service life of the rotatable member. Any suitable bearing such as a cast iron plain bearing may be used for bearing 22.

Figure 4:
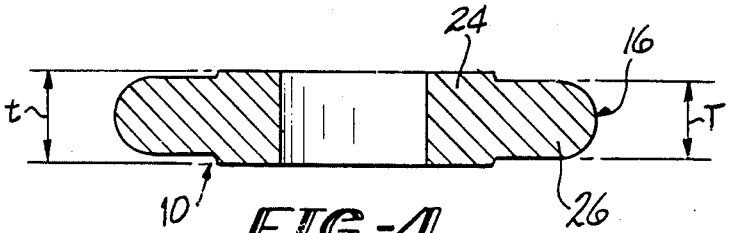
FIG. 4 is a cross sectional view of a rotatable member used in the device of FIG. 1.

Referring now to FIG. 4, the rotatable member 16 has a central portion 24 with a thickness t which is sufficiently large enough to enable the member 16 to act as a thrust bearing for minimizing frictional forces between the cylindrical body member 12 and itself. The member 16 further comprises a portion 25 on each side of the central portion having a thickness T and an end portion 26 which is preferably semicircular in cross section and has a radius substantially equal to half of the thickness T. It has been found that by providing such semi-circular end portions the contact area per rotatable member is maximized. Of course, the member 16 may have any desired diameter.

In accordance with the present invention, the service life of both the device 10 and the production pipe tubing 34 are improved by forming each rotatable member 16 from a metal or metal alloy having a hardness which at temperatures above 300° F. is from at least about 50 to about 150 Brinnel Hardness (HB), preferably about 50 HB, less than the hardness of the harder material forming the production tubing. It has been found that by using such a hardness differential, damage to the production tubing can be prevented.

The metal or metal alloy from which each member 16 is formed should be capable of maintaining the aforementioned relative hardness characteristics with respect to the production tubing substantially constant over time at the service temperatures encountered downhole of the well, generally about 300° F. It is also desirable that the material forming each member 16 age substantially at the same rate as the material forming the production tubing 34. Of course, the particular material selected for the members 16 is also in part determined by the corrosiveness and temperature of the fluid produced from the oil well. Suitable metallic materials for the rotatable members include, but are not limited to, copper alloys having a hardness in the range of from about 50 HB to about 200 HB and austenistic or ferritic stainless steel such as AISI 316. The production tubing 34 may be formed from API J55. In addition to the improving service life, it has been found that the above mentioned hardness differential reduces frictional wear of the tubing by the rotatable member.

While the member 12 may have any desired number of slots and the device 10 may have any number of rotatable members, it is preferred that there be six slots and six rotatable members. It has been found that when six slots and rotatable members are used, at least three of the rotatable members are always in contact with the production tubing.

It is apparent that there has been provided in accordance with this invention a sucker rod centralizer which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A device for centralizing at least one sucker rod within a production pipe downhole in a well and for reducing frictional forces between said pipe and said at least one sucker rod which comprises an elongate, substantially cylindrical body member having a longitudinal axis, a plurality of slots within said member and a rotatable member mounted within each slot; each of said plurality of slots has its major dimension along a first axis parallel to the longitudinal axis of said body member and is oriented with respect to the other slot so as to form a helicoidal array for maximizing the total surface contact area between the rotatable members and the pipe and for decreasing the forces acting on each rotatable member wherein each rotatable member rotates within said slot about a second axis substantially transverse to said first axis wherein the hardness of the material from which said rotatable members are formed have a hardness of from at least about 50 to about 150 Brinnel Hardness less than the hardness of the material from which the production tube is made wherein the relative hardness is maintained over time at the service temperatures encountered downhole in the well, that is, at temperatures of ≧300° F.

2. A device as set forth in claim 1 wherein said rotatable members are formed from a copper alloy.

3. A device as set forth in claim 1 wherein said rotatable members are formed from at least one of an austenistic and ferritic stainless steel.

4. A device as set forth in claim 1 further comprising a pin within each slot defining the rotational axis of the respective rotatable member, and a bearing between said pin and said rotatable member.

5. A device as set forth in claim 1 wherein adjacent ones of said slots are arranged at an angle of about 30° relative to each other.

6. A device as set forth in claim 1 wherein each rotatable member has a first portion with a desired thickness and end portions each having a radius substantially equal to about half of said desired thickness so as to maximize contact area.

7. A device as set forth in claim 1 wherein said body member has internally threaded longitudinally extending bores at each end for joining said device to a plurality of sucker rods.

* * * * *